US006665883B2

(12) United States Patent
Sloan

(10) Patent No.: US 6,665,883 B2
(45) Date of Patent: Dec. 23, 2003

(54) OVERSOCK

(76) Inventor: Dale A. Sloan, 5520 Abbey Hill Rd., Fort Wayne, IN (US) 46804

( * ) Notice: Subject to any disclaimer, the term of this patent is extended or adjusted under 35 U.S.C. 154(b) by 0 days.

(21) Appl. No.: 10/051,840

(22) Filed: Jan. 17, 2002

(65) Prior Publication Data

US 2003/0131397 A1 Jul. 17, 2003

(51) Int. Cl.[7] ..... A41B 11/00
(52) U.S. Cl. ..... 2/239
(58) Field of Search ..... 2/239, 240, 241, 2/242, 61, 22, DIG. 1; 36/97, 10, 1, 51, 7.1 R

(56) References Cited

U.S. PATENT DOCUMENTS

| | | | | | |
|---|---|---|---|---|---|
| 2,244,871 | A | * | 6/1941 | Guinzburg | 2/59 |
| 3,000,118 | A | * | 9/1961 | O'Shea | 36/10 |
| 4,204,345 | A | | 5/1980 | Bradley | |
| 4,206,515 | A | * | 6/1980 | Robinson | 2/241 |
| 4,296,499 | A | * | 10/1981 | Patterson et al. | 2/239 |
| 4,538,368 | A | * | 9/1985 | Mugford | 36/112 |
| 4,562,834 | A | * | 1/1986 | Bates et al. | 602/3 |
| 4,809,447 | A | | 3/1989 | Pacanowsky et al. | |
| 4,825,564 | A | * | 5/1989 | Sorce | 36/87 |
| 5,244,716 | A | * | 9/1993 | Thornton et al. | 428/198 |
| 5,325,541 | A | | 7/1994 | Willard | |
| 5,560,226 | A | * | 10/1996 | Throneburg | 66/185 |
| 5,603,232 | A | * | 2/1997 | Throneburg | 66/185 |
| 5,617,585 | A | * | 4/1997 | Fons et al. | 2/239 |
| 5,682,617 | A | * | 11/1997 | Tumas | 2/239 |
| 5,697,106 | A | * | 12/1997 | Baker et al. | 2/239 |
| 5,724,680 | A | * | 3/1998 | Cesnick et al. | 2/239 |
| 5,732,413 | A | * | 3/1998 | Williams | 2/169 |
| 6,047,403 | A | * | 4/2000 | Juozaitis | 2/61 |
| 6,067,731 | A | | 5/2000 | Chen et al. | |
| 6,247,182 | B1 | * | 6/2001 | Tasbas | 2/239 |

OTHER PUBLICATIONS

Cabela's Hunting, Fishing and Outdoor Gear, Master Catalog Fall 1998, p. 255, Cabela's Gore–Tex stretch socks.*

RedHead, Hunting Specialists Catalog, Fall 2001, Bass pro shops, p. 112, Rocky Gore–Tex Socks.*

* cited by examiner

*Primary Examiner*—John J. Calvert
*Assistant Examiner*—Alissa L. Hoey
(74) *Attorney, Agent, or Firm*—Baker & Daniels

(57) ABSTRACT

A waterproof oversock for covering a conventional sock so that outer footwear, e.g., shoes or boots, may be removed and the sock will be protected from a wet and/or dirty floor, e.g., a ski lodge floor. The oversock includes a foot portion and leg portion extending upwardly from the foot portion. The oversock is constructed from an elastic material, stretchable to fit over a conventional sock. The oversock is portable, flexible, and foldable into a small package to be carried in a conventional pant or coat pocket, for example.

19 Claims, 1 Drawing Sheet

OVERSOCK

BACKGROUND OF THE INVENTION

1. Field of the Invention

The present invention relates to an oversock designed to be worn over a conventional sock. More particularly, the present invention relates to a waterproof oversock with sufficient durability to allow the wearer to walk, without shoes, in a damp, or wet environment, without exposing the underlying sock to moisture.

2. Description of the Related Art

Often, a person may wish to remove their outer footwear, e.g., shoes or boots and wear only socks. In some cases, the environment is not conducive to wearing only socks, as the floors may be wet or dirty. One such environment is a ski lodge.

The sport of skiing requires specialized clothing and equipment designed to protect a skier in the harsh, winter environment. Such equipment includes ski boots designed to protect the skier's foot and ankle. Ski boots generally include a shell formed from rigid plastic and an inner liner. The ski boot is provided with several buckles to secure the skier's foot within the boot. The boot includes a foot portion and a leg portion, the leg portion being angled slightly toward the toe end of the foot portion making walking in the boots difficult.

During a day of skiing, it is common to go into the ski lodge to eat, warm up, or simply relax. At this time, skiers may prefer to remove their ski boots, however, in most ski lodges removing a skier's boots is not practical. The floor of the lodge is usually wet and dirty as other skiers walk into the lodge wearing snow-covered boots and outer clothing.

Typically, it is impractical to remove ski boots in a ski lodge and put on a different pair of shoes or boots, as ski lodges are not typically equipped with lockers of sufficient size to accommodate ski boots, and, moreover, changing into shoes once inside the ski lodge is time consuming and cumbersome. To allow for such a change into shoes, a skier must initially bring outer footwear, e.g., shoes or conventional boots into the lodge and store the footwear in a locker. When changing, the skier must retrieve the footwear from the locker, change, and either carry their ski boots or leave them outside of the unaccommodating locker. When the skier returns to the locker to change back into ski boots and replace the alternative footwear, e.g., shoes or boots in the locker, he typically must again pay to lock the locker. Not only is the process of changing from ski boots into, e.g., shoes or boots cumbersome and time consuming, but also shoes or boots may not provide the desired level of comfort. Moreover, bringing shoes to a ski lodge can prove to be problematic, as ski lodges are typically located on the summit of the mountain or hill being skied and, therefore, shoes brought to the lodge must, undesirably, be carried on the ski lift.

What is needed in the art is a covering for socks that is dirt and waterproof, lightweight, comfortable, and compact.

SUMMARY OF THE INVENTION

The present invention provides a compact and lightweight waterproof covering for a conventional sock so that outer footwear, e.g., shoes or boots may be removed and, with the covering of the present invention in place, the conventional sock will be protected from dirt and/or moisture. The oversock of the present invention is, in one exemplary embodiment, formed from an elastic material, stretchable to fit over a conventional sock. The oversock of the current invention is flexible and foldable into a small package to be carried in a pant or coat pocket, for example. The material of the oversock is durable so that the oversock will not tear when worn and may be reused if necessary. The oversock of the present invention may be formed of inexpensive materials to facilitate marketing, thereof, as a single use, i.e., disposable item. In one exemplary embodiment, the oversock includes a non-slip, texturized surface on the sole thereof.

The oversock of the present invention includes a foot portion and, in certain embodiments, a leg portion extending upwardly from the foot portion. In one exemplary embodiment, the foot portion and leg portion are constructed from a stretchable and durable material having a lamellar thickness in a range of 1–40 mils. In one exemplary embodiment, the sole of the oversock of the present invention will be formed from a material having a lamellar thickness of 1–40 mils, with the remainder of the oversock being formed from a material having a lamellar thickness in the range of 1–20 mils. In a further exemplary embodiment, the entire oversock is formed of a material having a lamellar thickness in the range of 2–10 mils, with the sole possibly having an increased thickness. Importantly, the oversock of the present invention is constructed of waterproof material of sufficient thickness and flexibility to allow the oversock to be easily carried in a standard pocket, e.g., a pant pocket, or jacket pocket. Generally, the oversock of the present invention is formed from a stretchable and durable material such as, e.g., latex, rubber, vinyl, synthetic nitrile, or polytetrafluoroethylene.

The present invention advantageously allows for removal of outer footwear, without fear that a wet and/or dirty floor, e.g., a ski lodge floor will foul the underlying socks.

BRIEF DESCRIPTION OF THE DRAWINGS

The above-mentioned and other features and advantages of this invention, and the manner of attaining them, will become more apparent and the invention itself will be better understood by reference to the following description of the embodiment of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DESCRIPTION OF THE PRESENT INVENTION

Figure 1:
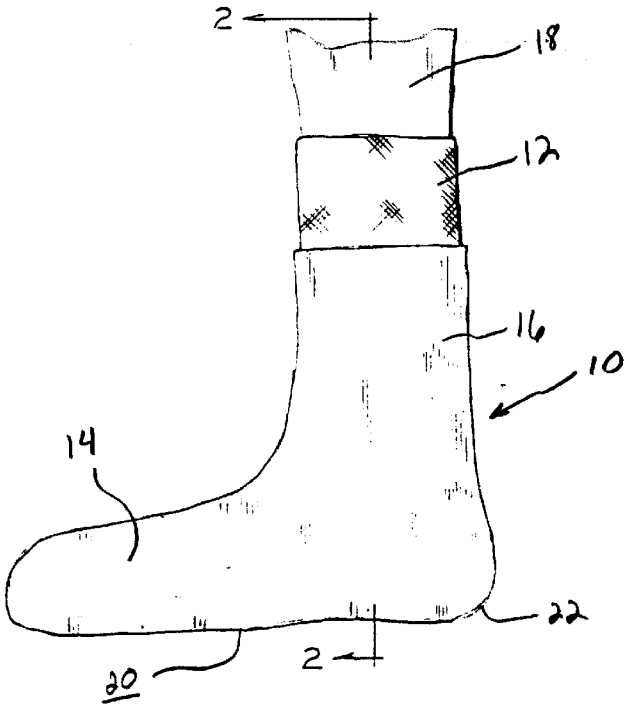
FIG. 1 is a side view of an oversock in accordance with the present invention.

Referring to FIG. 1, oversock 10 is worn over conventional sock 12 so that a person may walk without shoes or boots in an environment where wearing only socks 12 is impractical. Such an environment may include a ski lodge where it is desirable to remove heavy, uncomfortable ski boots yet the snow covered, wet, and dirty floor generally prevents a person from comfortably wearing only conventional socks 12.

Figure 2:
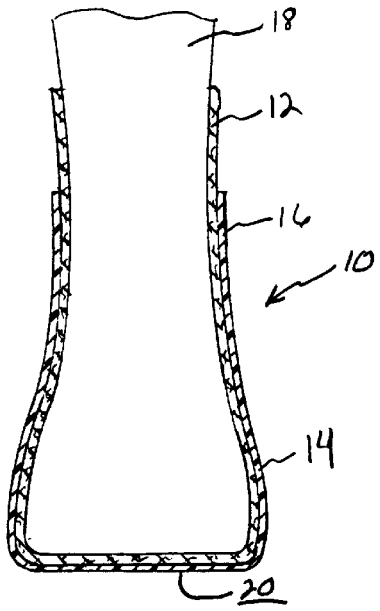
FIG. 2 is a sectional view of the oversock of FIG. 1 taken along line 2—2.

Oversock 10 has the shape of a conventional sock, including foot portion 14 and leg portion 16 extending upwardly therefrom and terminating at a point along wearers leg 18. Oversock 10, may be formed as a tube sock, or may include shaped heal 22. The length of leg portion 16 may be any suitable length including, e.g., relatively short, stopping just short of the ankle, i.e., extending approximately 2.5 centimeters (one inch) from foot portion 14, or relatively long, extending approximately 15 centimeters (6 inches) from foot portion 14 to mid-calf. Lower surface 20 is located over the bottom of the wearer's foot when oversock 10 is worn and, generally, is the portion of oversock 10 in contact with the floor. In one alternative embodiment, lower surface 20 of foot portion 14 is texturized. As illustrated in FIGS. 1 and 2, oversock 10 is sized to fit about sock 12. Oversock 10 may be provided in several sizes, each encompassing a range of three or four shoe sizes, similar to the sizing of a conventional sock.

Oversock 10 is constructed from a waterproof material to protect sock 12 from being dampened by wet floors. Further, oversock 10 is elastic and stretchable to fit securely about sock 12 and fit the contour of the wearer's foot. In one exemplary embodiment, oversock 10 is sufficiently durable to allow for repeated use and cleaning if necessary. In further embodiments of the present invention, oversock 10 is designed as a single use item.

Oversock 10 is conveniently portable, being flexible so that it may be folded and stored in a small package. This allows the user to carry oversock 10 in a conventional pocket of an article of clothing such as a pair of pants or a coat, eliminating the need to retrieve oversock 10 from a locker, for example. For the purposes of this document "conventional pocket" means a pocket found in an article of clothing as originally manufactured, e.g., a front pocket of a conventional pair of pants.

Oversock 10 may be constructed from any suitable material possessing the above described characteristics using any suitable method including, e.g., common methods of producing surgical gloves. Such materials include latex, rubber, vinyl, synthetic nitrile, or a waterproof, breathable material such as polytetrafluoroethylene commonly known by the trade name GORE-TEX. All of the above materials are flexible so that oversock 10 is easily foldable to be stored in a small, portable package. In one exemplary embodiment, foot portion 14 and leg portion 16 are constructed from one of the afformentioned materials having a lamellar thickness in the range of 1–40 mils. In one exemplary embodiment, lower surface 20 of oversock 10 will be formed of a material having a lamellar thickness in the range of 1–40 mils, with the remainder of oversock 10 being formed of a material having a lamellar thickness of 1–20 mils. In a further embodiment of the present invention, oversock 10 is formed from a material having a lamellar thickness of 2–10 mils. Generally, lower surface 20 of oversock 10 will have an increased lamellar thickness relative to the remainder of oversock 10, although it is contemplated that oversock 10 may be formed of a material having a substantially consistent lamellar thickness.

Oversock 10 may be conveniently sold in vending machines or in gift shops located in, e.g., a ski lodge. Materials of construction such as, e.g., latex, rubber, vinyl, or synthetic nitrile are relatively inexpensive, but nevertheless are sufficiently durable and abrasion resistant so that oversock 10 may be used throughout an entire day or more of skiing. These materials have varying degrees of elasticity and stretchability with latex and rubber being more elastic than synthetic nitrile and vinyl. When formed of materials such as latex, rubber, vinyl, or synthetic nitrile, oversock 10 can advantageously be sold at a sufficiently low price to facilitate marketing oversock 10 as a single use, i.e., disposable item.

When oversock 10 is constructed from GORE-TEX, oversock 10 is slightly more expensive and much more durable. These more expensive versions of oversock 10 are meant for more long term use relative to the aforementioned materials of construction and may be sold in, e.g., gift shops and sports stores, in addition to various on-site facilities.

The durability of oversock 10 not only relates to the material from which it is constructed but to the thickness of the material. The durability and thickness of oversock 10 are directly related, as increased thickness yields increased durability of oversock 10. However, a thicker oversock 10 may be more difficult to fold and keep compact when stored. Therefore, the thickness must be limited to allow the oversock to be stored in a conventional pocket as described above. An exemplary thickness of the material of oversock 10 to maintain durability and flexibility is in the range of 2–10 mils.

Figure 3:
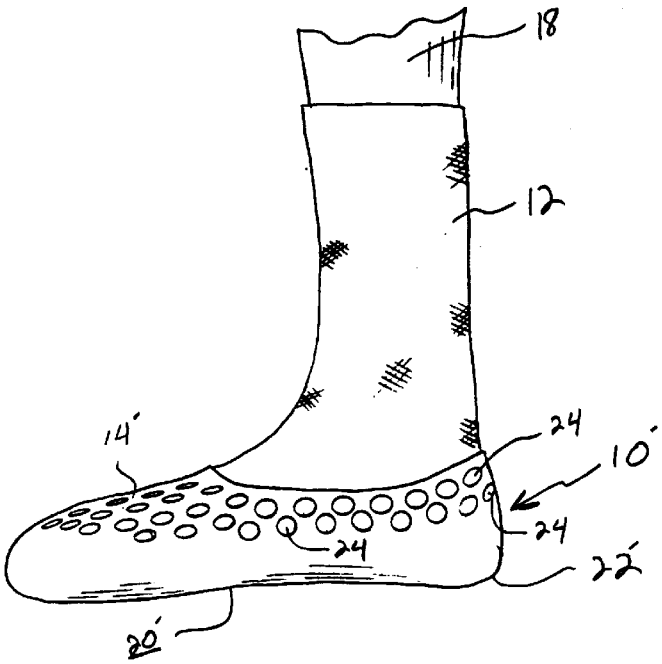
FIG. 3 is a side view of an alternative embodiment oversock of the present invention.

FIG. 3 illustrates alternative embodiment oversock 10'. Portions of oversock 10' corresponding to portions of oversock 10 illustrated in FIGS. 1 and 2 and indicated with primed references numerals and are not described here for the sake of brevity. As illustrated in FIG. 3, oversock 10' is sized to fit about the wearers foot and does not extend over the ankle. Oversock 10' includes vent holes 24 generally positioned on an upper surface thereof. Vent holes 24 are positioned on an upper surface of oversock 10' to facilitate drying of sock 12 which may contain moisture, including, i.e., perspiration developed while skiing. Vent holes 24 may be provided in oversock 10 illustrated in FIGS. 1 and 2.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A waterproof oversock formed of a flexible waterproof material comprising a foot portion including an open interior sized to accommodate a foot positioned therein, said foot portion having an opening through which the foot can travel to be placed in said open interior, said foot portion being constructed of the flexible waterproof material in a lamellar thickness of about 1–40 mils, said foot portion having a lower surface for being positioned beneath a sole of said foot, said lower surface constructed of the flexible waterproof material in an increased lamellar thickness relative to the non-lower surface portions of the waterproof oversock.

2. The waterproof oversock of claim 1, wherein said lower surface includes a texturized exterior surface.

3. The waterproof oversock of claim 1, wherein said material has a lamellar thickness in the range of about 2–10 mils.

4. The waterproof oversock of claim 1, wherein the waterproof oversock includes at least one vent aperture.

5. The waterproof oversock of claim 1, wherein said material is selected from the group consisting of latex, rubber, vinyl, and synthetic nitrile.

6. The waterproof oversock of claim 1, wherein said material is a polytetrafluoroethylene.

7. The waterproof oversock of claim 1, wherein said foot portion is elastic.

8. The waterproof oversock of claim 1, further comprising, a leg portion extending upwardly from said foot portion, said leg portion being constructed from said flexible waterproof material.

9. The waterproof oversock of claim 8, wherein said leg portion extends from said foot portion about 2.5 centimeters.

10. The waterproof oversock of claim 8, wherein said leg portion extends from said foot portion about 15 centimeters.

11. A method of shielding an individual's foot from moisture when the individual is not wearing outer footwear, comprising:

providing a waterproof oversock formed of a flexible waterproof material comprising a foot portion including an open interior sized to accommodate a foot positioned therein, said foot portion having an opening through which the foot can travel to be placed in said open interior, said foot portion being constructed of the flexible waterproof material in a lamellar thickness of about 1–40 mils, said foot portion having a lower surface for being positioned beneath a sole of said foot, said lower surface constructed of the flexible waterproof material in an increased lamellar thickness relative to the non-sole portions of the waterproof oversock; placing the foot through said opening and into said open interior; and placing an exterior surface of said lower surface on a moisture containing floor.

12. The method of claim 11, wherein said material has a lamellar thickness in the range of about 2–10 mils.

13. The method of claim 11, wherein said oversock includes at least one vent aperture, said vent aperture located in a non lower surface portion of the waterproof oversock.

14. The method of claim 11, wherein said material is selected from the group consisting of latex, rubber, vinyl, and synthetic nitrile.

15. The method of claim 11, wherein said waterproof oversock is elastic, and wherein said step of placing the foot through said opening and into said open interior comprises the further step of stretching the waterproof oversock to accommodate placement of the foot through said opening and into said open interior.

16. A method of shielding an individual's foot from moisture while allowing a sock worn by the individual to dry, comprising:

providing a waterproof oversock formed of a flexible waterproof material comprising a foot portion including an open interior sized to accommodate a foot positioned therein, said foot portion having an opening through which the foot can travel to be placed in said open interior, said foot portion being constructed of the flexible waterproof material in a lamellar thickness of about 1–40 mils, said foot portion having a lower surface for being positioned beneath a sole of said foot, said lower surface constructed of the flexible waterproof material in an increased lamellar thickness relative to the non-lower surface portions of the waterproof oversock, said waterproof oversock including at least one vent aperture, said vent aperture located in a non-lower surface portion of the waterproof oversock; and placing the foot through said opening and into said open interior.

17. The method of claim 16, wherein said material has a lamellar thickness in the range of about 2–10 mils.

18. The method of claim 16, wherein said material is selected from the group consisting of latex, rubber, vinyl, and synthetic nitrile.

19. The method of claim 16, wherein said waterproof oversock is elastic, and wherein said step of placing the foot through said opening and into said open interior comprises the further step of stretching the waterproof oversock to accommodate placement of the foot through said opening and into said open interior.

* * * * *